US012350788B2

(12) United States Patent
Sekiya

(10) Patent No.: US 12,350,788 B2
(45) Date of Patent: Jul. 8, 2025

(54) DRESSING MEMBER

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 966 days.

(21) Appl. No.: 17/240,266

(22) Filed: Apr. 26, 2021

(65) Prior Publication Data

US 2021/0362295 A1 Nov. 25, 2021

(30) Foreign Application Priority Data

May 22, 2020 (JP) ..... 2020-089848

(51) Int. Cl.
*B24B 53/12* (2006.01)

(52) U.S. Cl.
CPC ..... *B24B 53/12* (2013.01)

(58) Field of Classification Search
CPC . H01L 21/78; H01L 21/304; H01L 21/68327; B24B 53/12; B24B 7/228; B24B 27/06; B24B 37/042; B24B 53/14; B24B 53/053; B24B 53/007; B24B 53/06; B24D 5/022; B24D 53/06; B24D 7/08; B24D 7/12; B24D 5/02; B26D 7/08; B26D 7/12; B26D 7/02; B23D 63/001; B23D 63/005; B23D 63/105
USPC ..... 451/443; 125/3–5
See application file for complete search history.

(56) References Cited

U.S. PATENT DOCUMENTS 6,344,402 B1 * 2/2002 Sekiya ..... H01L 21/67092 438/464
6,726,526 B2 * 4/2004 Sekiya ..... H01L 21/67092 451/65
2001/0023691 A1 * 9/2001 Sekiya ..... B28D 5/0076 125/13.01
2008/0306432 A1 * 12/2008 Kumagai ..... B27B 5/32 604/22
2008/0313875 A1 * 12/2008 Tomooka ..... B25B 9/00 29/270
2013/0029566 A1 1/2013 Suzuki et al.
(Continued)

FOREIGN PATENT DOCUMENTS

CN 110587450 A 12/2019
JP 62-151729 U 9/1987
JP H04146649 A 5/1992
(Continued)

OTHER PUBLICATIONS

Machine translation of JP-2012187693-A (Year: 2012).*
(Continued)

*Primary Examiner* — Robert F Neibaur
(74) *Attorney, Agent, or Firm* — GREER BURNS & CRAIN, LTD.

(57) ABSTRACT

A dressing member to be used for dressing of a cutting blade carried out by a cutting apparatus including a chuck table that holds a workpiece, a cutting unit that cuts the workpiece held by the chuck table by a cutting blade, a cassette mounting section on which a cassette accommodating the workpieces is mounted, and a conveying unit that conveys the workpiece between the cassette mounted on the cassette mounting section and the chuck table, includes a dressing board to be cut by the cutting blade and a rigid plate fixed to the dressing board.

7 Claims, 7 Drawing Sheets

(56) References Cited

U.S. PATENT DOCUMENTS

| | | | | |
|---|---|---|---|---|
| 2018/0215010 | A1* | 8/2018 | Sekiya | B24B 53/12 |
| 2019/0358757 | A1 | 11/2019 | Terada | |

FOREIGN PATENT DOCUMENTS

| | | | | |
|---|---|---|---|---|
| JP | 2001110756 | A | | 4/2001 |
| JP | 2012187692 | A | | 10/2012 |
| JP | 2012187693 | A | * | 10/2012 |
| JP | 2013202740 | A | | 10/2013 |
| JP | 2015093341 | A | | 5/2015 |
| JP | 2018114575 | A | | 7/2018 |
| TW | 201304904 | A | | 2/2013 |

OTHER PUBLICATIONS

Office Action issued by the Patent Office of Japan in co-pending Japanese Patent Application No. 2020-089848, dated Feb. 7, 2024.
Office Action issued in counterpart Chinese patent application No. 202110532560.1, dated Apr. 11, 2025.

* cited by examiner

DRESSING MEMBER

BACKGROUND OF THE INVENTION

Field of the Invention

The present invention relates to a dressing member to be used for dressing of a cutting blade for cutting a workpiece.

Description of the Related Art

By dividing a wafer formed with a plurality of devices such as integrated circuits (ICs) and large scale integration (LSI) circuits, device chips including the devices respectively are manufactured. In addition, after a plurality of device chips are mounted on a predetermined substrate, the device chips mounted are coated with a sealing material (molding resin) including a resin, whereby a package substrate is obtained. By dividing the package substrate, package devices including a plurality of device chips packaged are manufactured. The device chips and package devices are mounted on various electronic apparatuses such as mobile phones and personal computers.

At the time of dividing a workpiece such as the wafer and the package substrate mentioned above, a cutting apparatus is used. The cutting apparatus includes a chuck table that holds the workpiece, and a cutting unit to which an annular cutting blade for cutting the workpiece is mounted. By causing the cutting blade to cut into the workpiece while rotating the cutting blade, the workpiece is cut and divided. The workpieces are accommodated in a cassette in a state of being supported by an annular frame through a tape. Then, the cutting apparatus takes out the workpieces supported by the frames one by one from the cassette, conveys the workpiece to the chuck table, and processes the workpiece by the cutting blade. The workpiece after processing is again accommodated into the cassette after being cleaned (see, for example, Japanese Patent Laid-open No. 2001-110756).

At the time of processing the workpiece by the cutting blade, dressing of intentionally wearing a tip portion of the cutting blade is conducted, for the purpose of correcting the shape of the cutting blade or securing sharpness of the cutting blade. For example, the dressing is conducted by holding, by a chuck table of a cutting apparatus, a plate-shaped member (dressing board) for dressing the cutting blade, and causing the cutting blade to cut into the dressing board. The cutting blade includes abrasive grains and a binding material for fixing the abrasive grains. When dressing is conducted, the binding material makes is worn by making contact with the dressing board, whereby the shape of the cutting blade is adjusted to a circle (generation of roundness), and the abrasive grains are exposed appropriately from the binding material (dressing). By use of the cutting blade thus dressed, accuracy of processing is enhanced.

The dressing board is supported by an annular frame, like the workpiece. Specifically, the dressing board is supported by the frame through a tape, in a state of being disposed inside a circular opening provided in a central portion of the frame (see, for example, Japanese Patent Laid-open No. 2012-187692). As a result, the cutting apparatus can treat the dressing board similarly to the workpiece, and dressing of the cutting blade can be carried out by an operation similar to that at the time of cutting the workpiece by the cutting blade.

SUMMARY OF THE INVENTION

When dressing of a cutting blade is conducted, linear grooves are sequentially formed on a front surface side of the dressing board. Then, when the grooves are formed over the whole area of the dressing board, the used dressing board is discarded, and is replaced by a new dressing board. Therefore, by enlarging the dressing board in size to increase the number of the grooves capable of being formed in a single dressing board, the frequency of replacement of the dressing board can be lowered, and a reduction in cost can be realized.

However, in the case of carrying out the dressing of the cutting blade by use of a cutting apparatus, the dressing board is supported by an annular frame like the workpiece. Therefore, the dressing board needs to be formed in such a size that it can be disposed inside the opening of the frame. In addition, for securely holding the dressing board by the chuck table, the size of the dressing board is set such that the whole part of the dressing board is held by a holding surface of the chuck table. As a result, the size of the dressing board is limited, and enlargement of the dressing board in size is limited.

Besides, in order to support the dressing board by the annular frame, it is necessary to attach a tape to the dressing board and the frame. Therefore, the tape is consumed each time of replacement of the dressing board, leading to an increase in cost.

The present invention has been made in consideration of such a problem. Accordingly, it is an object of the present invention to provide a dressing member capable of reducing cost.

In accordance with an aspect of the present invention, there is provided a dressing member to be used for dressing of a cutting blade carried out by a cutting apparatus including a chuck table that holds a workpiece, a cutting unit that cuts the workpiece held by the chuck table by the cutting blade, a cassette mounting section on which a cassette accommodating the workpieces is mounted, and a conveying unit that conveys the workpiece between the cassette mounted on the cassette mounting section and the chuck table, the dressing member including: a dressing board to be cut by the cutting blade; and a rigid plate fixed to the dressing board, in which conveying out of the dressing member from the cassette by the conveying unit, holding of the dressing member by the chuck table, and conveying in of the dressing member into the cassette by the conveying unit are possible.

Note that preferably, the dressing member includes an information display section that displays information concerning the dressing board. In addition, preferably, the chuck table includes a circular holding surface that holds the workpiece and a rigid plate, the dressing board is rectangular in shape, and a length of a diagonal of the dressing board is greater than a diameter of the holding surface. Besides, preferably, the workpiece is supported by an annular frame through a tape, and an outline of a peripheral edge of the rigid plate corresponds to an outline of a peripheral edge of the frame.

The dressing member according to an aspect of the present invention includes the dressing board to be cut by the cutting blade, and the rigid plate fixed to the dressing board. As a result, it is possible to enlarge the dressing board in size and to realize a reduction in cost, while performing conveyance and holding of the dressing member in the cutting apparatus similarly to the workpiece unit.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
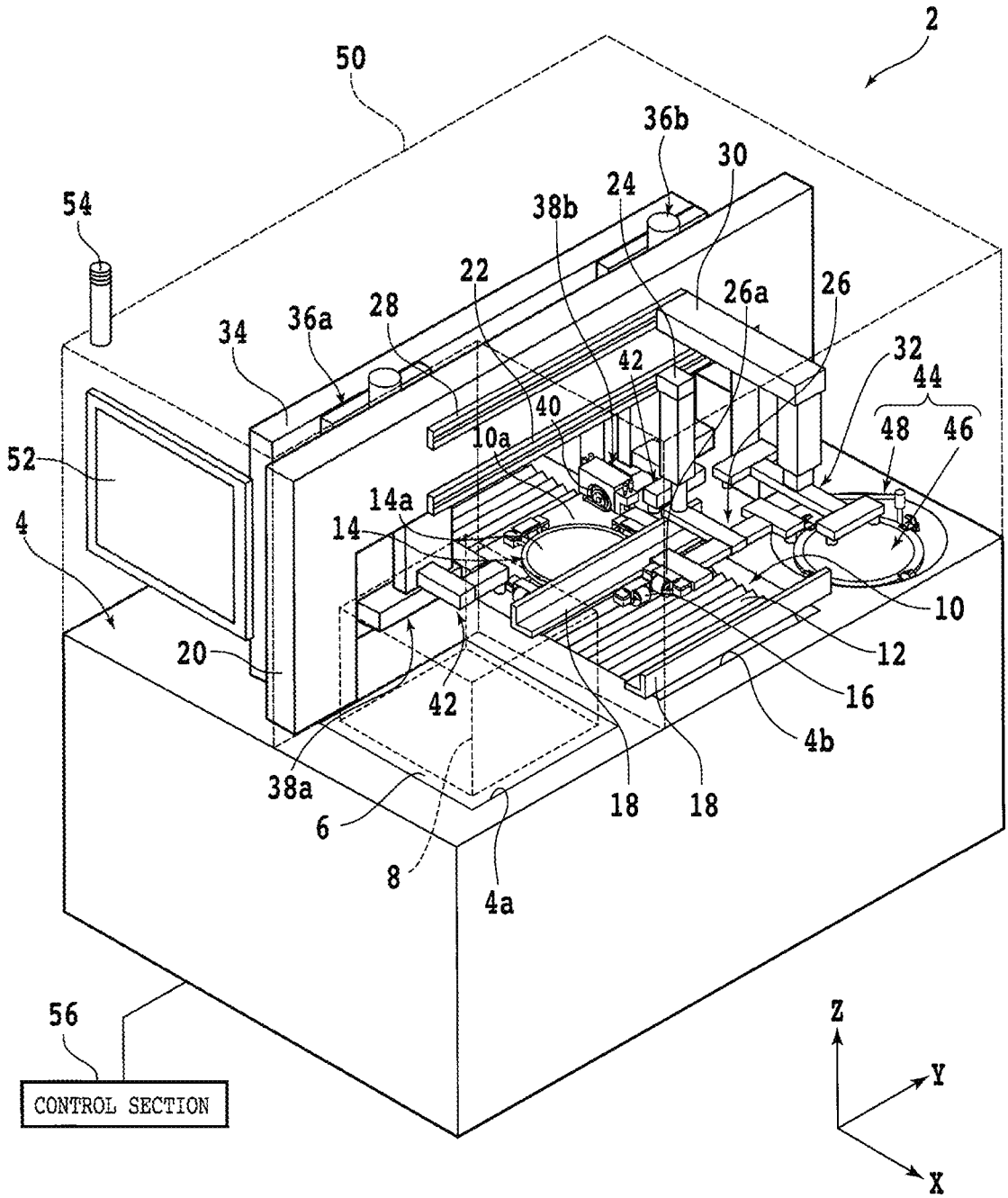
FIG. 1 is a perspective view depicting a cutting apparatus.

An embodiment according to one mode of the present invention will be described below referring to the attached drawings. First, a configuration example of a cutting apparatus capable of carrying out dressing of a cutting blade by use of a dressing member according to the present embodiment will be described. FIG. 1 is a perspective view depicting the cutting apparatus 2. Note that in FIG. 1, an X-axis direction (a processing feeding direction, a first horizontal direction, a front-rear direction) and a Y-axis direction (an indexing direction, a second horizontal direction, a left-right direction) are mutually perpendicular directions. In addition, a Z-axis direction (a vertical direction, an upward-downward direction, a height direction) is a direction perpendicular to both the X-axis direction and the Y-axis direction.

The cutting apparatus 2 includes a base 4 that supports or accommodates components constituting the cutting apparatus 2. In a corner portion on the front side of the base 4, a rectangular opening 4*a* opening on an upper surface side of the base 4 is formed. In addition, on a lateral side of the opening 4*a*, a rectangular opening 4*b* which opens on an upper surface side of the base 4 and a longitudinal direction of which is along the X-axis direction is formed.

In the inside of the opening 4*a*, a cassette mounting section (cassette mounting base) 6 on which to mount a cassette 8 capable of a workpiece unit 11 (see FIG. 2) and a dressing member 23 (see FIG. 3) described later is mounted is provided. A lifting mechanism (not illustrated) is connected to the cassette mounting section 6, and the lifting mechanism lifts the cassette mounting section 6 upward and downward along the Z-axis direction. The cassette 8 is mounted on an upper surface of the cassette mounting section 6. Note that only an outline of the cassette 8 is indicated by a broken line in FIG. 1.

Figure 2:
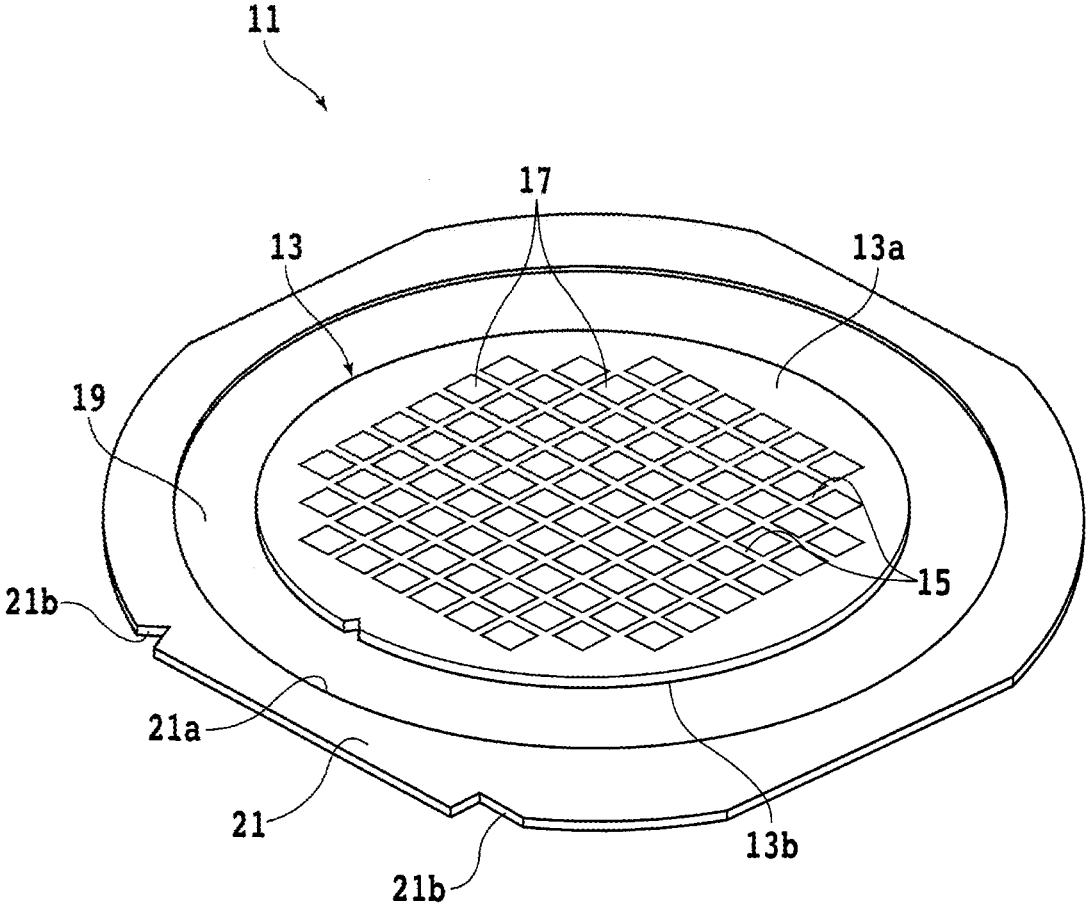
FIG. 2 is a perspective view depicting a workpiece unit.

FIG. 2 is a perspective view depicting the workpiece unit (frame unit) 11 accommodated in the cassette 8. The workpiece unit 11 includes a workpiece 13 to be an object of cutting by the cutting apparatus 2. The workpiece 13 is, for example, a disk-shapes semiconductor wafer formed of silicon or the like, and includes a front surface 13*a* and a back surface 13*b* which are substantially parallel to each other. The workpiece 13 is partitioned into a plurality of rectangular regions by a plurality of streets 15 arranged in a grid pattern such as to intersect each other. In addition, devices 17 such as ICs and LSIs are each formed on the front surface 13*a* side of the regions partitioned by the streets 15. By cutting the workpiece 13 along the streets 15 and dividing the workpiece 13, a plurality of device chips including the devices 17 can each be obtained.

Note that the material, shape, structure, size and the like of the workpieces 13 are not limited. For example, the workpiece 13 may be a wafer having a given shape and size and formed of a semiconductor other than silicon (GaAs, InP, GaN, SiC, etc.), sapphire, glass, ceramic, resin, metal, or the like. In addition, the kind, number, shape, structure, size, layout and the like of the devices 17 are also not limited, and the workpieces 13 may not necessarily be formed with the devices 17. Further, the workpiece 13 may be a package substrate such as a chip size package (CSP) substrate and a quad flat non-leaded package (QFN) substrate.

A circular tape (dicing tape) 19 larger in diameter than the workpiece 13 is attached to the back surface 13*b* side of the workpiece 13. For example, as the tape 19, a sheet or the like having a film-shaped base material formed in a circular shape and an adhesive layer (glue layer) provided on the base material is used. The base material is formed of a resin such as polyolefin, polyvinyl chloride, and polyethylene terephthalate, while the adhesive layer is formed of an epoxy, acrylic, or rubber adhesive or the like. In addition, for the adhesive layer, an ultraviolet-curing type resin curable by irradiation with ultraviolet rays may be used.

A peripheral portion of the tape 19 is attached to an annular frame 21 formed of a metal such as stainless steel (SUS). The frame 21 is formed in a central portion thereof with a circular opening 21*a* larger in diameter than the workpiece 13. The workpiece 13 is attached to a central portion of the tape 19 such as to be located on the inside of the opening 21*a* of the frame 21. As a result, the workpiece 13 is supported by the frame 21 through the tape 19, to constitute the workpiece unit 11. Note that the frame 21 is provided at a part of a peripheral portion thereof with a pair of mark sections 21*b* indicating the orientation of the frame 21. For example, as the mark sections 21*b*, cutout sections are formed at a part of the peripheral portion of the frame 21.

Figure 3:
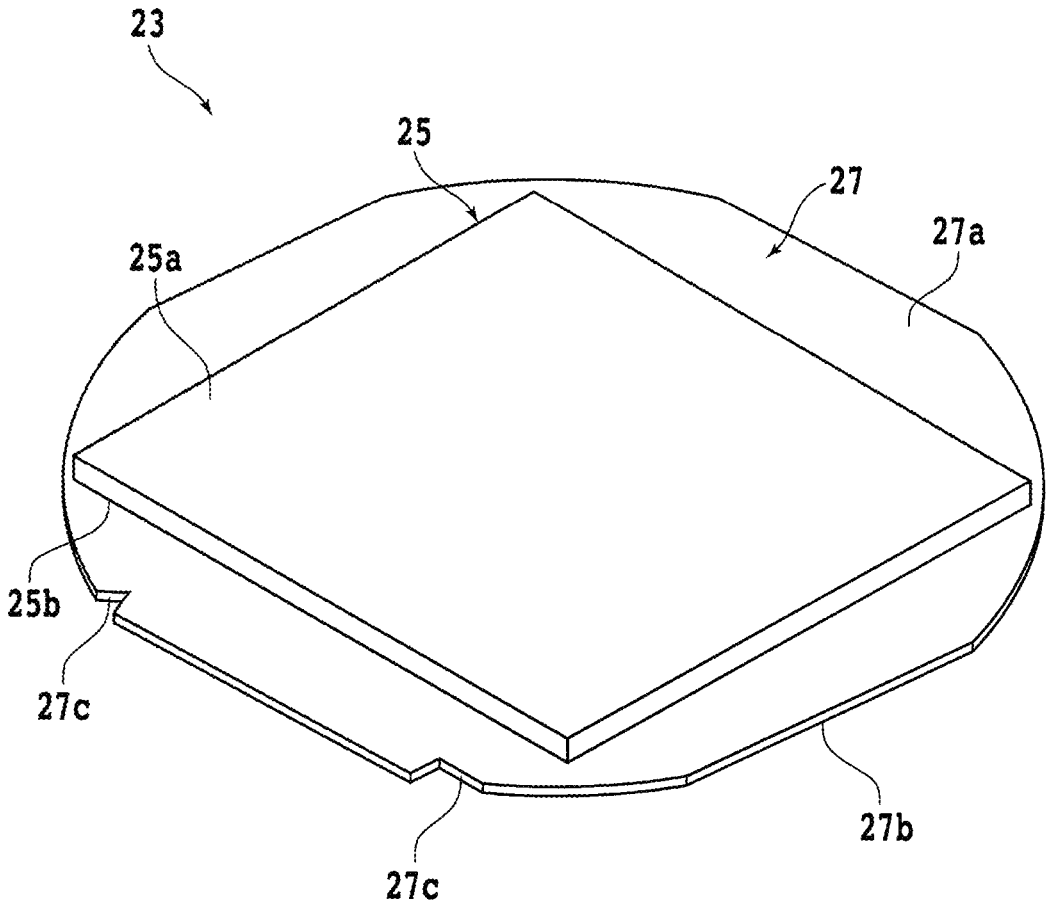
FIG. 3 is a perspective view depicting a dressing member.

FIG. 3 is a perspective view depicting a dressing member (dressing unit) 23 accommodated in the cassette 8 together with the workpiece unit 11. The dressing member 23 is a member to be used for dressing of a cutting blade 40 described later. The dressing member 23 includes a plate-shaped dressing board 25. The dressing board 25 is formed, for example, in a rectangular shape in plan view, and includes a front surface 25*a* and a back surface 25*b* which are substantially parallel to each other. The dressing board 25 includes abrasive grains and a binding material (bond material) for fixing the abrasive grains. For example, the dressing board 25 is formed by fixing abrasive grains of green carborundum (GC), white alundum (WA), or the like by a binding material such as a resin bond and a vitrified bond.

Note that the materials of the abrasive grains and the binding material contained in the dressing board 25 are not limited, but are appropriately selected according to the material, thickness, diameter, and the like of the cutting blade 40 to be an object of dressing. Further, the content, grain diameter and the like of the abrasive grains contained in the dressing board 25 are not limited. For example, the abrasive grains are contained in the dressing board 25 in a weight ratio of 55% to 65%. In addition, an average grain diameter of the abrasive grains is, for example, 0.1 to 50 μm. The method for forming the dressing board 25 is also not limited. For example, the abrasive grains are impregnated with a resin such as a phenolic resin and an epoxy resin, after which the resin is molded into a plate-like shape, and is fired at a predetermined temperature (for example, approximately 150° C. to 200° C.), whereby the dressing board 25 is formed.

A plate-shaped rigid plate 27 is fixed to the dressing board 25. The rigid plate 27 is a member having such a rigidity as to be able to support the dressing board 25, and includes a front surface 27*a* and a back surface 27*b* which are substantially parallel to each other. The rigidity of the rigid plate 27 is set in such a manner that the front surface 25*a* and the back surface 25*b* of the dressing board 25 are maintained in the state of being parallel to the holding surface 14*a* of the chuck table 14 when the dressing board 25 is cut by the cutting blade 40 (see FIG. 7B) as described later. Examples of the material of the rigid plate 27 include resins (plastics and the like), glasses (quartz glass, borosilicate glass, etc.), ceramics, metals and the like. For example, a plastic plate of a thickness of 2 to 10 mm can be used as the rigid plate 27. Since plastics are lighter than metals such as SUS, when the rigid plate 27 is formed of a plastic, conveyance of the rigid plate 27 is facilitated.

The dressing board 25 is fixed on the front surface 27*a* side of the rigid plate 27. For example, the dressing board 25 is adhered to the rigid plate 27 through an adhesive in such a manner that the whole part of the back surface 25*b* makes contact with the front surface 27*a* side of the rigid plate 27. As the adhesive, for example, a pressure sensitive adhesive resin such as an epoxy resin and an acrylic resin can be used. As a result, the dressing board 25 is supported by the rigid plate 27, to constitute the dressing member 23.

The rigid plate 27 is provided at a part of a peripheral portion thereof with a pair of mark sections 27*c* indicating the orientation of the rigid plate 27. For example, as the mark sections 27*c*, cutout regions (cutout sections) are formed at a part of the peripheral portion. The shape of the mark sections 27*c* may be the same as the shape of the mark sections 21*b* (see FIG. 2) of the frame 21.

Figure 4:
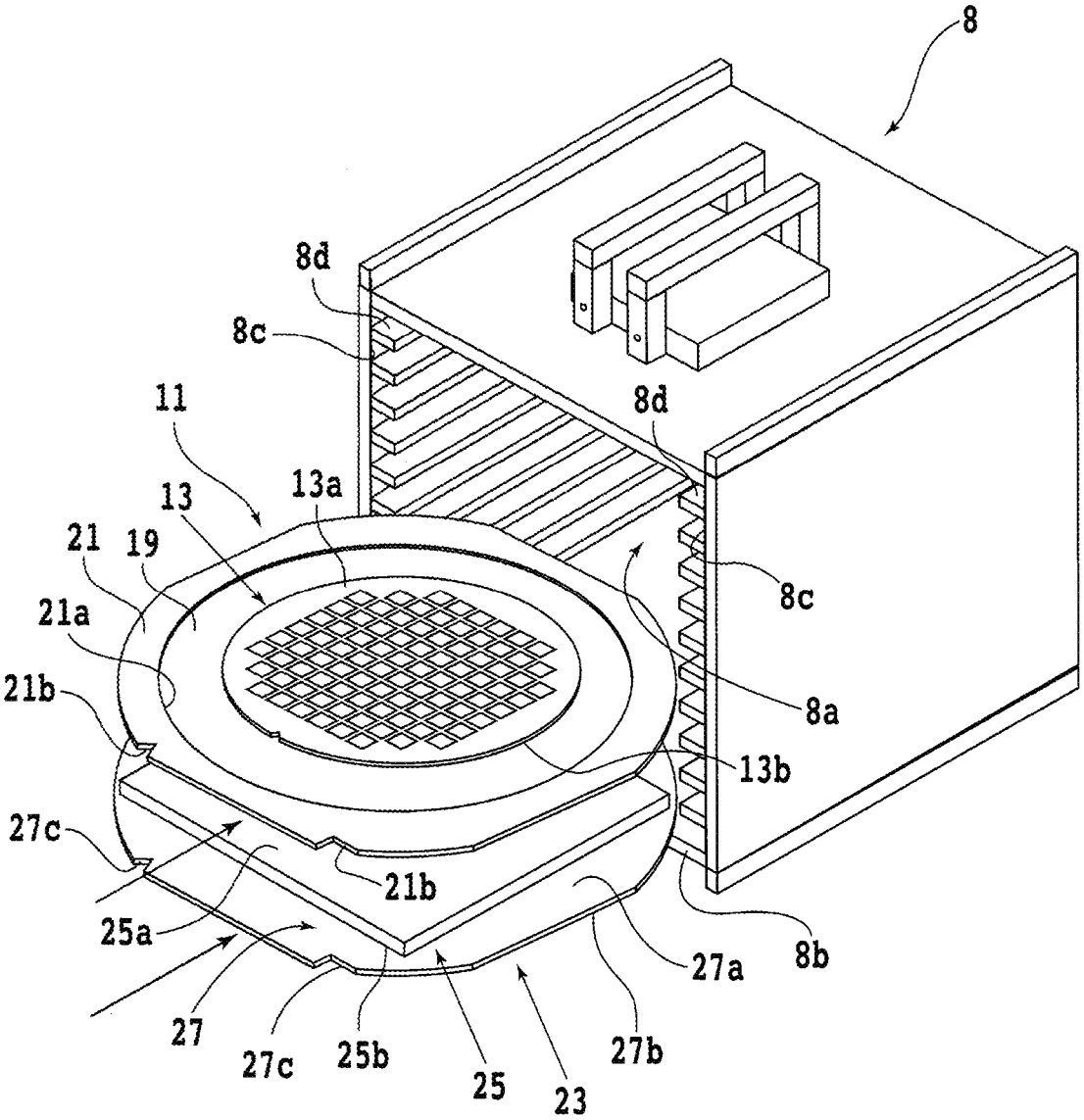
FIG. 4 is a perspective view depicting a cassette for accommodating the workpiece unit and the dressing member.

FIG. 4 is a perspective view depicting the cassette 8 in which the workpiece unit 11 and the dressing member 23 are accommodated. For example, the cassette 8 is formed in a rectangular parallelepiped box shape, and includes therein a rectangular parallelepiped accommodation section 8*a* capable of accommodating a plurality of workpiece units 11 and dressing members 23. The accommodation section 8*a* is connected to the external space through a rectangular opening formed in a side surface 8*b* of the cassette 8. Through the opening, conveyance (conveying-out from the cassette 8 and conveying-in into the cassette 8) of the workpiece units 11 and the dressing members 23 is conducted.

In the inside of the accommodation section 8*a*, a pair of side walls 8*c* face each other. The pair of side walls 8*c* are provided with a plurality of stages of pairs of guide rails 8*d* that support the workpiece units 11 and the dressing members 23. When the workpiece unit 11 is inserted into the accommodation section 8*a* of the cassette 8, the lower surface side of the frame 21 is supported by a pair of guide rails 8*d*. In addition, when the dressing member 23 is inserted into the accommodation section 8*a* of the cassette 8, the back surface 27*b* side of the rigid plate 27 is supported by a pair of guide rails 8*d*. Note that the workpiece unit 11 is accommodated in the cassette 8 such that the mark sections 21*b* of the frame 21 are disposed in a predetermined direction. Similarly, the dressing member 23 is accommodated in the cassette 8 such that the mark sections 27*c* of the rigid plate 27 are disposed in a predetermined direction. As a result, the orientations of the workpiece units 11 and the dressing members 23 can be aligned.

The sizes and shapes of the frame 21 and the rigid plate 27 are not limited insofar as the frame 21 and the rigid plate 27 can be accommodated in the cassette 8. For example, the rigid plate 27 is formed in such a manner that an outline of a peripheral edge of the rigid plate 27 corresponds to an outline of a peripheral edge of the frame 21. More specifically, the rigid plate 27 can be formed in such a manner that when the frame 21 and the rigid plate 27 are placed on each other, the difference between the position of the peripheral edge of the frame 21 and the position of the peripheral edge of the rigid plate 27 is equal to or less than 10 mm, preferably equal to or less than 5 mm. In addition, particularly in the case where the frame 21 is annular in shape and the rigid plate 27 is disk-like in shape, the rigid plate 27 can be formed in such a manner that the difference between the outside diameter (outside diameter of the peripheral edge) of the frame 21 and the outside diameter (outside diameter of the peripheral edge) of the rigid plate 27 is equal to or less than 20 mm, preferably equal to or less than 10 mm. With the outline of the frame 21 and the outline of the rigid plate 27 thus corresponding to each other, the dressing member 23 can be handled similarly to the workpiece unit 11 in the cutting apparatus 2, and the conveyance and holding of the dressing member 23 can be carried out similarly to those of the workpiece unit 11.

The size of the rigid plate 27 may be greater than the size of the frame 21. More specifically, the rigid plate 27 may be formed such that when the frame 21 and the rigid plate 27 are laid on each other, a peripheral edge of the rigid plate 27 is disposed on the outside of a peripheral edge of the frame 21. In this case, as compared to the case where the frame 21 and the rigid plate 27 are the same in size, the area of the front surface 27*a* of the rigid plate 27 is large, and the rigid plate 27 can support a dressing board 25 larger in size.

The cassette 8 accommodating the workpiece units 11 and the dressing members 23 is mounted on the cassette mounting section 6 depicted in FIG. 1. In this instance, the cassette 8 is disposed in such a manner that the side surface 8*b* formed with the opening is directed to the opening 4*b* side of the base 4.

A ball screw type moving mechanism 10 and a bellows-shaped dust and drip-proof cover 12 covering a part of the moving mechanism 10 are disposed inside the opening 4*b*. The moving mechanism 10 includes a moving table 10*a* exposed from the dust and drip-proof cover 12, and moves the moving table 10*a* along the X-axis direction.

On the moving table 10*a* is provided a chuck table (holding table) 14 that holds the workpiece units 11 and the dressing members 23. An upper surface of the chuck table 14 constitutes a holding surface 14*a* for holding the workpiece units 11 and the dressing members 23. In addition, a plurality of clamps 16 for gripping the frame 21 of the workpiece unit 11 to fix the frame 21 are provided in the periphery of the chuck table 14. The moving mechanism 10 moves the chuck table 14 in the X-axis direction together with the moving table 10*a*. In addition, the chuck table 14 is connected to a rotational drive source (not illustrated) such as a motor, and the rotational drive source rotates the chuck table 14 around a rotational axis which is substantially parallel to the Z-axis direction.

On the front side on an upper side of the opening 4*b* of the base 4, a pair of guide rails 18 brought closer to and away from each other while keeping a state of being substantially parallel to the Y-axis direction are provided. The pair of guide rails 18 each include a support surface for supporting a lower surface side of the workpiece unit 11 (lower surface side of the frame 21) and a lower surface side of the dressing member 23 (back surface 27*b* side of the rigid plate 27), and a side surface substantially perpendicular to the support surface and making contact with a peripheral edge of the frame 21 or a peripheral surface of the rigid plate 27. The pair of guide rails 18 clamp the workpiece unit 11 and the dressing member 23 along the X-axis direction, and performs alignment of the workpiece unit 11 and the dressing member 23.

In addition, a gate-shaped first support structure 20 is disposed on an upper surface of the base 4 in the manner of straddling the opening 4*b*. On a front surface side (guide rail 18 side) of the first support structure 20, a rail 22 is fixed along the Y-axis direction. A conveying unit (conveying mechanism) 26 is connected to the rail 22 through a moving mechanism 24. The moving mechanism 24 moves the conveying unit 26 in the Y-axis direction along the rail 22. In addition, the moving mechanism 24 includes an air cylinder, and the air cylinder incorporates a rod which moves upward and downward along the Z-axis direction. At a lower end portion of the rod of the air cylinder, the conveying unit 26 is fixed. The conveying unit 26 is moved upward and downward in the Z-axis direction by the moving mechanism 24, and is moved in the Y-axis direction along the rail 22. In addition, at a tip portion on the opening 4*a* side (cassette 8 side) of the conveying unit 26, a grasping section (grasping mechanism) 26*a* that grasps the workpiece unit 11 and the dressing member 23 is provided.

The conveying unit 26 conveys the workpiece unit 11 between the cassette 8 and the chuck table 14. Specifically, the conveying unit 26, in a state of grasping the frame 21 of the workpiece unit 11 accommodated in the cassette 8 by the grasping section 26*a*, moves along the Y-axis direction such as to space away from the cassette 8. As a result, the workpiece unit 11 is conveyed out from the cassette 8, and is disposed on the pair of guide rails 18. Thereafter, the conveying unit 26 holds the frame 21 of the workpiece unit 11 disposed on the pair of guide rails 18, and coneys the workpiece unit 11 onto the chuck table 14. In addition, the conveying unit 26, in a state of grasping the frame 21 of the workpiece unit 11 disposed on the pair of guide rails 18 by the grasping section 26*a*, moves along the Y-axis direction such as to approach the cassette 8. As a result, the workpiece unit 11 is conveyed and accommodated into the cassette 8.

Similarly, the conveying unit 26 conveys the dressing member 23 between the cassette 8 and the chuck table 14. Specifically, the conveying unit 26, in a state of grasping the rigid plate 27 of the dressing member 23 accommodated in the cassette 8 by the grasping section 26*a*, moves along the Y-axis direction such as to space from the cassette 8. As a result, the dressing member 23 is conveyed out from the cassette 8, and is disposed on the pair of guide rails 18. Thereafter, the conveying unit 26 holds the rigid plate 27 of the dressing member 23 disposed on the pair of guide rails 18, and conveys the dressing member 23 onto the chuck table 14. In addition, the conveying unit 26, in a state of grasping the rigid plate 27 of the dressing member 23 disposed on the pair of guide rails 18, moves along the Y-axis direction such as to approach the cassette 8. As a result, the dressing member 23 is conveyed and accommodated into the cassette 8.

Further, the conveying unit 26 conveys the workpiece unit 11 and the dressing member 23 between a cleaning unit 44 described later and the pair of guide rails 18. The workpiece unit 11 and the dressing member 23 cleaned by the cleaning unit 44 are conveyed onto the guide rails 18 by the conveying unit 26.

On a front surface side of the first support structure 20, a rail 28 is fixed along the Y-axis direction. A conveying unit (conveying mechanism) 32 is connected to the rail 28 through a moving mechanism 30. The respective configurations of the moving mechanism 30 and the conveying unit 32 are similar to the configurations of the moving mechanism 24 and the conveying unit 26. The conveying unit 32 conveys the workpiece unit 11 and the dressing member 23 between the chuck table 14 and the cleaning unit 44.

On the rear side of the first support structure 20, a gate-shaped second support structure 34 is disposed in the manner of straddling the opening 4*b*. A pair of ball screw type moving mechanisms 36*a* and 36*b* are fixed at both side end portions on a front surface side (first support structure 20 side) of the second support structure 34. In addition, a cutting unit 38*a* is fixed to a lower portion of the moving mechanism 36*a*, and a cutting unit 38*b* is fixed to a lower portion of the moving mechanism 36*b*. The cutting units 38*a* and 38*b* cut the workpiece 13 of the workpiece unit 11 by annular cutting blades 40. By moving the cutting unit 38*a* in the Y-axis direction and the Z-axis direction by the moving mechanism 36*a*, the positions in the Y-axis direction and the Z-axis direction of the cutting unit 38*a* are adjusted. In addition, by moving the cutting unit 38*b* in the Y-axis direction and the Z-axis direction by the moving mechanism 36*b*, the positions in the Y-axis direction and the Z-axis direction of the cutting unit 38*b* are adjusted.

Figure 6A:
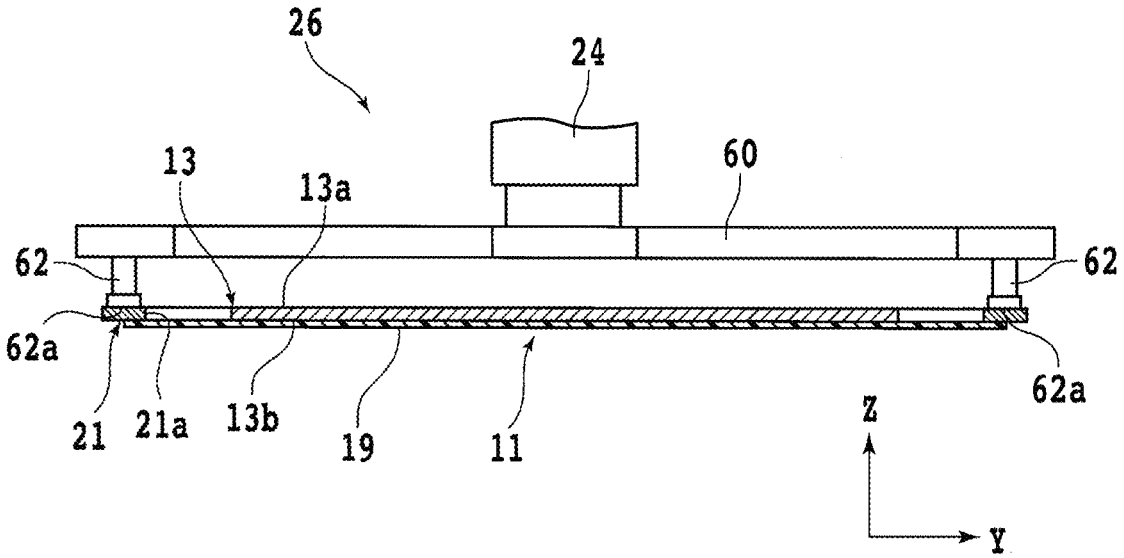
FIG. 6A is a partially sectional front view depicting the workpiece unit conveyed by a conveying unit.
Figure 6B:
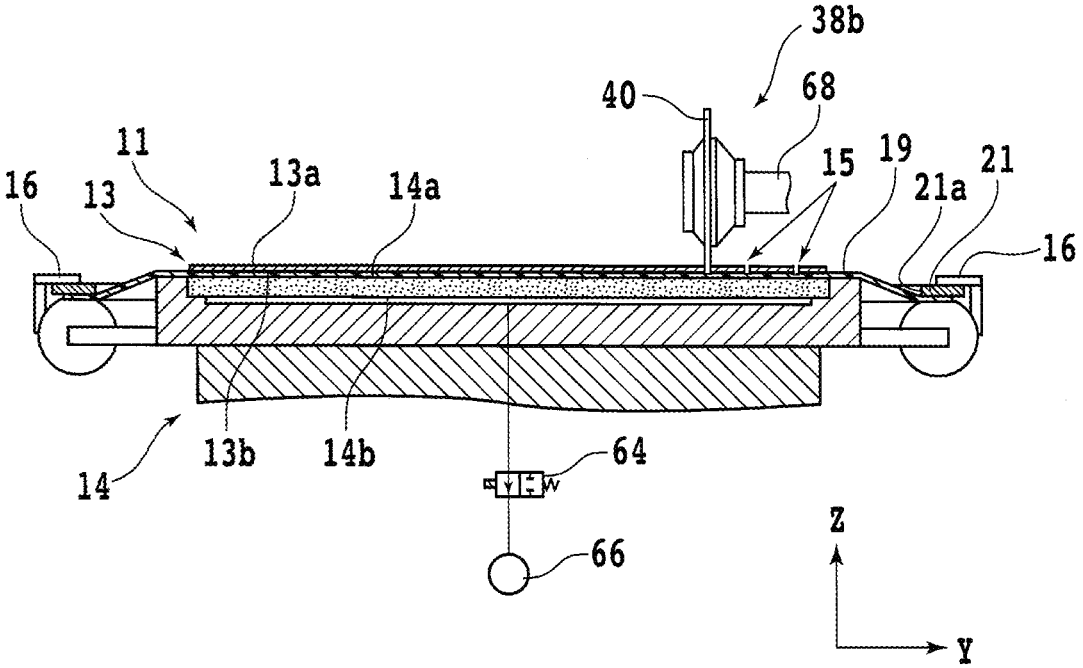
FIG. 6B is a partially sectional front view depicting the workpiece unit held by a chuck table.
Figure 7A:
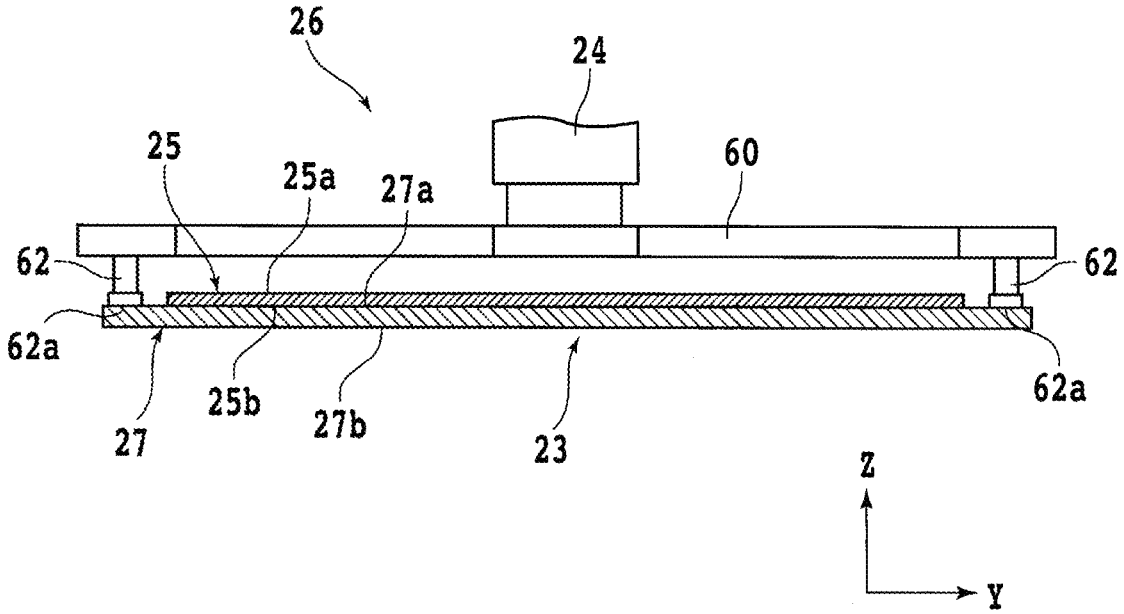
FIG. 7A is a partially sectional front view depicting the dressing member conveyed by a conveying unit.
Figure 7B:
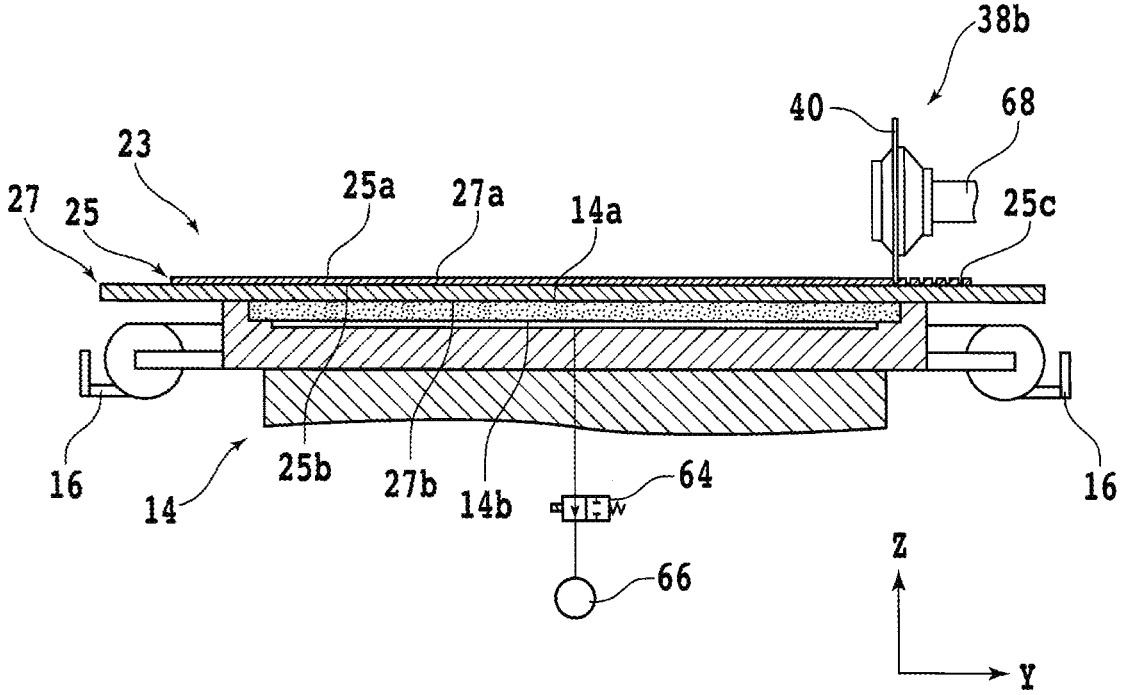
FIG. 7B is a partially sectional front view depicting the dressing member held by the chuck table.

The cutting units 38*a* and 38*b* each include a cylindrical spindle 68 (see FIGS. 6B and 7B). To a tip portion of the spindle 68, the annular cutting blade 40 is mounted. The cutting blade 40 is a processing tool for cutting into the workpiece 13 to cut the workpiece 13. As the cutting blade 40, for example, a hub type cutting blade including an annular base formed of a metal or the like and an annular cutting edge integrally formed along a peripheral edge of the base is used. The cutting edge of the hub type cutting blade includes an electroformed grindstone in which abrasive grains of diamond, cubic boron nitride (cBN) or the like are fixed by a binding material such as nickel plating. In addition, as the cutting blade 40, a washer type cutting blade including an annular cutting edge in which abrasive grains are fixed by a binding material such as a metal, a ceramic, and a resin may also be used.

Note that FIG. 1 depicts an example of what is called a facing dual spindle type cutting apparatus in which the cutting apparatus 2 includes two sets of cutting unit 38*a* and 38*b*, and a pair of cutting blades 40 are disposed to face each other. It is to be noted that the number of sets of the cutting units provided in the cutting apparatus 2 may be one.

Imaging units (cameras) 42 that image the workpiece units 11 and the dressing members 23 held by the chuck table 14 and the like are provided at positions respectively adjacent to the cutting units 38*a* and 38*b*. For example, the imaging unit 42 includes a visible light camera including an imaging element that receives visible light and converts it into an electrical signal, an infrared camera including an imaging element that receives infrared light and converts it into an electrical signal, or the like. On the basis of images acquired by the imaging units 42, alignment between the workpieces 13 of the workpiece units 11 held by the chuck table 14 and the cutting units 38*a* and 38*b* is conducted. In addition, On the basis of images acquired by the imaging units 42, alignment between the dressing boards 25 of the dressing members 23 held by the chuck tables 14 and the cutting units 38*a* and 38*b* is performed.

A cleaning unit 44 is disposed on a lateral side on the opposite side of the opening 4*b* from the opening 4*a*. The cleaning unit 44 includes a spinner table 46 that holds the workpiece unit 11 and the dressing member 23 in a cylindrical cleaning space. A rotational drive source (not illustrated) that rotates the spinner table 46 around a rotational axis which is substantially parallel to the Z-axis direction is connected to the spinner table 46. On an upper side of the spinner table 46, a nozzle 48 for supplying a cleaning fluid (for example, a mixed fluid obtained by mixing water and air) toward the workpiece unit 11 and the dressing member 23 held by the spinner table 46 is disposed. In a state in which the workpiece unit 11 is held by the spinner table 46, the fluid is supplied from the nozzle 48 while rotating the spinner table 46, whereby the workpiece unit 11 is cleaned. Similarly, the dressing member 23 held by the spinner table 46 is cleaned.

After the workpiece 13 is cut by the cutting units 38*a* and 38*b*, the workpiece unit 11 is conveyed by the conveying unit 32 to the cleaning unit 44, to be cleaned by the cleaning unit 44. Thereafter, the workpiece unit 11 is conveyed by the conveying unit 26 onto the pair of guide rails 18, and is accommodated into the cassette 8. Similarly, after the dressing board 25 is cut by the cutting unit 38*a* and 38*b*, the dressing member 23 is conveyed by the conveying unit 32 to the cleaning unit 44, to be cleaned by the cleaning unit 44. Thereafter, the dressing member 23 is conveyed by the conveying unit 26 onto the pair of guide rails 18, and is accommodated into the cassette 8.

On an upper side of the base 4, a cover 50 covering the components disposed on the base 4 is provided. In FIG. 1, only an outline of the cover 50 is indicated by the broken line. On a side surface side of the cover 50, a display section (display unit, display device) 52 that displays various kinds of information concerning the cutting apparatus 2 is provided. For example, the display section 52 includes a touch panel functioning as a user interface. In this case, the display section 52 functions also as an input section (input unit, input device) for inputting information to the cutting apparatus 2.

In addition, on an upper surface of the cover 50, an alarm section (alarm unit) 54 for giving predetermined information to the operator is provided. For example, the alarm section 54 includes an alarm lamp, which is turned on or blinked when an abnormality is generated in the cutting apparatus 2, to inform the operator of generation of the abnormality. In addition, the alarm section 54 may include a speaker or the like generating a sound or voice for giving predetermined information.

The components (the cassette mounting section 6, the moving mechanism 10, the chuck table 14, the clamps 16, the guide rails 18, the moving mechanism 24, the conveying unit 26, the moving mechanism 30, the conveying unit 32, the moving mechanisms 36*a* and 36*b*, the cutting units 38*a* and 38*b*, the imaging units 42, the cleaning unit 44, the display section 52, the alarm section 54, etc.) constituting the cutting apparatus 2 are connected to a control section (control unit) 56. The control section 56 generates control signals for controlling operations of the components of the cutting apparatus 2, and controls operations of the cutting apparatus 2. For example, the control section 56 includes a computer, which includes a processing section that performs various processing (arithmetic processing etc.) necessary for the operation of the cutting apparatus 2, and a storage section in which to store various information (data, program, etc.) to be used for processing by the processing section. The processing section includes a processor such as a central processing unit (CPU). In addition, the storage section includes various kinds of memories constituting a main storage device, an auxiliary storage device, and the like.

The cutting apparatus 2 cuts the workpiece 13 of the workpiece unit 11 accommodated in the cassette 8 by the cutting blade 40 to process the workpiece 13. In addition, the cutting apparatus 2 cuts the dressing board 25 of the dressing member 23 accommodated in the cassette 8 by the cutting blade 40, to perform dressing of the cutting blade 40.

Figure 5A:
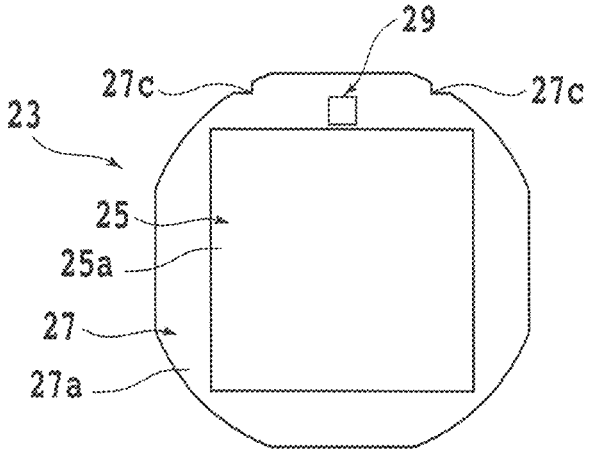
FIG. 5A is a plan view depicting the dressing member including an information display section.

Note that the dressing member 23 accommodated in the cassette 8 may include a region (information display section) that displays information concerning the dressing board 25. FIG. 5A is a plan view depicting the dressing member 23 including an information display section 29. For example, the information display section 29 is a bar code or a two-dimensional code indicative of information concerning the dressing board 25, and is imparted to the front surface 27*a* side of the rigid plate 27. Examples of the information concerning the dressing board 25 that is included in the information display section 29 include a size, a kind (material of the binding material, material of abrasive grains, grain diameter of the abrasive grains, etc.), and a serial number of the dressing board 25, the kind of the cutting blade 40 as an object of use of the dressing board 25, etc.

Figure 5B:
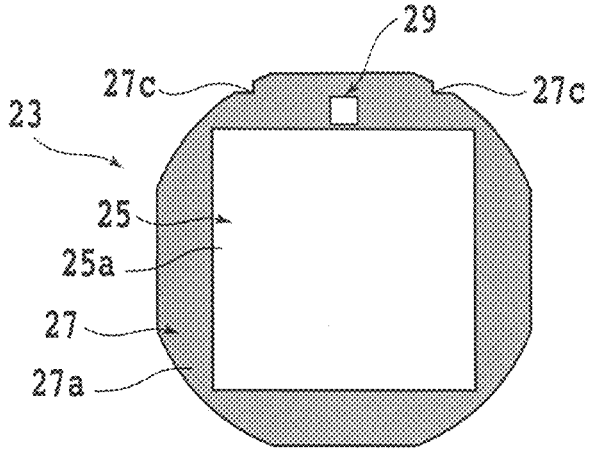
FIG. 5B is a plan view depicting the dressing member of which a rigid plate is colored.

In addition, a color representing information concerning the dressing board 25 may be imparted to the dressing member 23. FIG. 5B is a plan view depicting the dressing member 23 in which the rigid plate 27 is colored. For example, when the front surface 27*a* side of the rigid plate 27 is colored according to the kind of the dressing board 25, the operator can easily distinguish the kind of the dressing board 25. In this case, the front surface 27*a* side of the rigid plate 27 colored functions as the information display section.

Figure 5C:
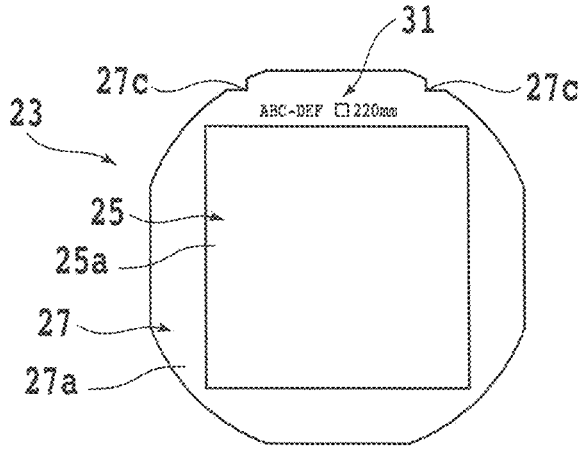
FIG. 5C is a plan view depicting the dressing member including the information display section that displays information concerning a dressing board in symbols.

Further, a symbol (character, numeral, figure, etc.) representing information concerning the dressing board 25 may be imparted to the dressing member 23. FIG. 5C is a plan view depicting the dressing member 23 including an information display section 31 representing the information concerning the dressing board 25 in symbol. In the dressing member 23 depicted in FIG. 5C, the information display section 31 representing the name and size of the dressing board 25 in symbols is imparted to the front surface 23*a* side of the dressing member 23. When this information display section 31 is imparted, the operator can grasp the name and size of the dressing board 25 instantaneously upon looking at the dressing board 25.

Note that the method for extracting information from the information display section 29 and 31 is not limited. For example, the operator visually checks directly the information display section 29 and 31 imparted to the dressing member 23, and grasps the information included in the information display section 29 and 31. In addition, the information display section 29 and 31 may be imaged by the imaging unit 42 (see FIG. 1), and an image obtained by the imaging may be displayed in an enlarged form on the display section 52. In this case, the operator confirms the information display section 29 and 31 enlargedly displayed on the display section 52, and can grasp the information included in the information display section 29 and 31. In addition, the cutting apparatus 2 may be provided with a reading unit by which to read the information display section 29 and 31. For example, in the case where the information display section 29 and 31 includes a symbol (character, numeral, figure, etc.), a bar code, or a two-dimensional code, the cutting apparatus is provided with a reader for reading the symbol, a bar code reader for reading the bar code, or a two-dimensional code reader for reading the two-dimensional code. Note that the imaging unit 42 may have a function as a reading unit, or a reading unit may be provided independently from the imaging unit 42.

The information (read information) read by the reading unit is inputted to the control section 56 (see FIG. 1). Then, the control section 56 reads the information concerning the dressing board 25 indicated by the read information from a storage section, and displays it on the display section 52. As a result, the operator can grasp the information concerning the dressing board 25.

Note that the propriety of the dressing board 25 may be determined by the control section 56, on the basis of the read information. For example, in the case where the dressing board 25 from which the information is read by the reading unit is a dressing board to be used for dressing of the cutting blade 40 mounted on the cutting units 38*a* and 38*b*, the control section 56 determines that the dressing board 25 is a proper dressing board. Then, the control section 56 operates the cutting apparatus 2 as usual, to continue dressing of the cutting blade 40. On the other hand, in the case where the dressing board 25 is not a dressing board to be used for dressing of the cutting blade 40 mounted to the cutting unit 38*a* and 38*b* or in the case where the number of grooves already formed in the dressing board 25 by the past dressing has reached a predetermined number, the control section 56 determines that the dressing board 25 is an improper dressing board. Then, the control section 56 stops the operation of the cutting apparatus 2. Note that in the case where the dressing board 25 is improper, the control section 56 may inform it to the display section 52 or the alarm section 54. For example, the control section 56 displays, on the display section 52, a message that the dressing board 25 is improper, and turns on or blinks the alarm section 54.

Next, a specific example of the operation of the cutting apparatus 2 when processing of the workpiece 13 and dressing of the cutting blade 40 are conducted will be described.

At the time of processing the workpiece 13 by the cutting apparatus 2, first, the workpiece unit 11 (see FIG. 4) accommodated in the cassette 8 is conveyed out by the conveying unit 26. Specifically, in a state in which an end portion of the frame 21 is grasped by a grasping section 26*a*, the conveying unit 26 moves along the Y-axis direction such as to space away from the cassette 8. As a result, the workpiece unit 11 is drawn out of the cassette 8 and is disposed onto the pair of guide rails 18. Then, the workpiece unit 11 is clamped between the pair of guide rails 18, and aligning of the workpiece unit 11 is performed.

Next, the workpiece unit 11 is conveyed onto the chuck table 14 by the conveying unit 26. FIG. 6A is a partially sectional front view depicting the workpiece unit 11 conveyed by the conveying unit 26. Note that FIG. 6A omits illustration of the grasping section 26*a* (see FIG. 1). The conveying unit 26 includes a plate-shaped base 60 connected to a lower end portion of the moving mechanism 24, and a plurality of suction pads 62 fixed to a lower surface side of the base 60. Lower surfaces of the suction pads 62 constitute holding surfaces 62*a* for suction holding an upper surface side of the workpiece unit 11. The holding surfaces 62*a* are connected to a suction source (not illustrated) such as an ejector through flow channels (not illustrated) formed inside the suction pads 62, a valve (not illustrated) and the like. The conveying unit 26 is disposed in such a manner that the holding surfaces 62*a* of the plurality of suction pad 62 make contact with an upper surface of the frame 21 of the workpiece unit 11. When a negative pressure of the suction source is permitted to act on the holding surfaces 62*a* of the suction pads 62 in this state, the frame 21 is suction held by the conveying unit 26. Then, the workpiece unit 11 is conveyed onto the chuck table 14 by the conveying unit 26, and is held by the chuck table 14.

FIG. 6B is a partially sectional front view depicting the workpiece unit 11 held by the chuck table 14. The holding surface 14*a* of the chuck table 14 is connected to a suction source 66 such as an ejector through a flow channel 14*b* formed inside the chuck table 14, a valve 64, and the like. The workpiece 13 is disposed on the chuck table 14 through the tape 19. In addition, the plurality of clamps 16 are put into a closed state, whereby the frame 21 is fixed by the plurality of clamps 16. When a negative pressure of the suction source 66 is permitted to act on the holding surface 14*a* by opening the valve 64 in this state, the workpiece 13 is suction held by the chuck table 14 through the tape 19.

Then, the workpiece 13 is processed by the cutting blade 40 mounted to the cutting unit 38*a* or the cutting blade 40 mounted to the cutting unit 38*b*. Note that in FIG. 6B the manner of processing the workpiece 13 by the cutting blade 40 mounted to the cutting unit 38*b* is depicted, but the cutting blade 40 mounted to the cutting unit 38*a* may be used for processing the workpiece 13.

The cutting units 38*a* and 38*b* each include a cylindrical spindle 68 disposed along the Y-axis direction. The cutting blade 40 is fixed to a tip portion (one end side) of the spindle 68, and a rotational drive source (not illustrated) such as a motor is connected to a base end portion (other end side) of the spindle 68. When the spindle 68 is rotated by the rotational drive source, the cutting blade 40 fixed to the spindle 68 is rotated around a rotational axis which is substantially parallel to the Y-axis direction. By permitting the cutting blade 40 to cut into the workpiece 13 while rotating the cutting blade 40, cutting of the workpiece 13 is conducted. For example, the cutting blade 40 cuts into the workpiece 13 along the street 15 in a cutting-in depth exceeding the thickness of the workpiece 13. As a result, the workpiece 13 is divided into a plurality of device chips.

When processing of the workpiece 13 is completed, an upper surface side of the frame 21 is held by the conveying unit 32 (see FIG. 1), and the workpiece unit 11 is conveyed from the chuck table 14 to the cleaning unit 44. Note that the configuration and function of the conveying unit 32 are similar to those of the conveying unit 26 depicted in FIG. 6A. Then, cleaning of the workpiece 13 is conducted by the cleaning unit 44. When the cleaning of the workpiece 13 is completed, the workpiece unit 11 is conveyed onto the pair of guide rails 18 by the conveying unit 26. Then, alignment of the workpiece unit 11 is conducted by the pair of guide rails 18. Thereafter, the conveying unit 26, in a state of grasping the frame 21 by the grasping section 26*a*, moves toward the cassette 8 side, and accommodates the workpiece unit 11 into the cassette 8. In this way, the processing of the workpiece 13 by the cutting blade 40 is conducted.

In addition, before using a new cutting blade 40 or after cutting the workpiece 13 by the cutting blade 40 by a predetermined amount, dressing for intentionally wearing a tip portion of the cutting blade 40 is conducted for the purpose of correcting the shape of the cutting blade 40 or securing sharpness of the cutting blade 40. This dressing is performed by permitting the cutting blade 40 to cut into the dressing board 25 of the dressing member 23.

The cutting apparatus 2 performs dressing of the cutting blade 40, by treating the dressing member 23 (see FIG. 4) accommodated in the cassette 8 similarly to the workpiece unit 11 at the time of processing the workpiece 13. Specifically, first, in a state in which an end portion of the rigid plate 27 of the dressing member 23 is grasped by the grasping section 26*a* of the conveying unit 26, the conveying unit 26 is moved in the Y-axis direction such as to space away from the cassette 8. As a result, the dressing member 23 is drawn out of the cassette 8 and is disposed onto the pair of guide rails 18. Then, the dressing member 23 is clamped between the pair of guide rails 18, and alignment of the dressing member 23 is conducted.

Next, the dressing member 23 is conveyed onto the chuck table 14 by the conveying unit 26. FIG. 7A is a partially sectional front view depicting the dressing member 23 conveyed by the conveying unit 26. The conveying unit 26 is disposed in such a manner that the holding surfaces 62*a* of the plurality of suction pads 62 each make contact with the front surface 27*a* of the rigid plate 27 of the dressing member 23. Note that the front surface 27*a* of the rigid plate 27 includes a region which is not overlapped with the dressing board 25, and the holding surfaces 62*a* of the plurality of suction pads 62 make contact with this region. When a negative pressure of the suction source is permitted to act on the holding surfaces 62*a* of the suction pads 62 in this state, the rigid plate 27 is suction held by the conveying unit 26. Then, the dressing member 23 is conveyed onto the chuck table 14 by the conveying unit 26, and is held by the chuck table 14.

FIG. 7B is a partially sectional front view depicting the dressing member 23 held by the chuck table 14. The dressing board 25 is disposed on the chuck table 14 through the rigid plate 27. Note that the clamps 16 are in an open state in this instance, and do not make contact with the dressing member 23. When the valve 64 is opened in this state to permit a negative pressure of the suction source 66 to act on the holding surface 14*a*, the dressing board 25 is suction held by the chuck table 14 through the rigid plate 27.

Then, the dressing board 25 is cut by the cutting blade 40 mounted to the cutting unit 38*a* or the cutting blade 40 mounted to the cutting unit 38*b*. As a result, the cutting blade 40 is worn, and dressing of the cutting blade 40 is conducted. Specifically, in a state in which a lower end of the cutting blade 40 is positioned below the front surface 25*a* of the dressing board 25, the chuck table 14 is moved in a processing feeding direction while rotating the cutting blade 40. As a result, the cutting blade 40 cuts into the dressing board 25, and a tip portion of the cutting blade 40 is worn by making contact with the dressing board 25. When the cutting blade 40 makes contact with the dressing board 25, the shape of the cutting blade 40 is adjusted to a circle concentric with the spindle 68 (generation of roundness) and the abrasive grains of the cutting blade 40 are exposed appropriately from the binding material (dressing). In this way, dressing of the cutting blade 40 is conducted. In addition, when the dressing is conducted, the dressing board 25 is formed with linear grooves 25*c*.

Here, in the dressing member 23 according to the present embodiment, the dressing board 25 is supported by the rigid plate 27, in place of being supported by the annular frame 21 (see FIG. 2) as in the conventional technology. Then, the size of the dressing board 25 can be freely set within such a range that the whole part of the dressing board 25 is supported by the rigid plate 27.

For example, in the case where the dressing board 25 is supported by the annular frame 21, the dressing board 25 needs to be formed in a size that can be disposed inside the opening 21*a* (see FIG. 2) of the frame 21. On the other hand, in the case where the dressing board 25 is supported by the rigid plate 27, the aforementioned limitation is absent. Therefore, a length of the diagonal of the dressing board 25 can be set larger than a diameter of the opening 21*a* of the frame 21. In addition, when the dressing board 25 is held by the chuck table 14, the whole part of the dressing board 25 is supported by the rigid plate 27, and, therefore, the dressing board 25 may not necessarily be formed smaller than the holding surface 14*a* of the chuck table 14. For example, the length of the diagonal of the dressing board 25 can be larger than a diameter of the holding surface 14*a* of the chuck table 14. In this case, as depicted in FIG. 7B, a part of the dressing board 25 is disposed in the outside (a region not overlapping with the holding surface 14*a*) of the holding surface 14*a*.

As above-mentioned, when the rigid plate 27 is used for supporting the dressing board 25, the dressing board 25 can be enlarged in size. When the dressing board 25 is enlarged in size, the number of the grooves 25*c* capable of being formed in a single dressing board 25 is increased, and the number of the dressing board 25 used for dressing the cutting blade 40 is reduced. As a result, the frequency of exchange of the dressing board 25 is reduced, and cost is reduced. Note that the size of the dressing board 25 is as large as possible, within such a range that the dressing board 25 can be supported by the rigid plate 27. For example, the dressing board 25 is formed in such a size that the area of the front surface 27*a* of the rigid plate 27 covered by the dressing board 25 is equal to or more than 50%, preferably equal to or more than 70%, on the basis of the total area of the front surface 27*a* of the rigid plate 27.

In addition, in the case where the dressing board 25 is supported by the rigid plate 27, unlike the case where the dressing board 25 is supported by the annular frame 21 (see FIG. 2), it is unnecessary to attach the tape 19 (see FIG. 2) to the dressing board 25. As a result, it is possible to suppress consumption of the tape 19 and to realize a reduction in cost.

Note that while FIG. 7B depicts the manner in which dressing of the cutting blade 40 mounted to the cutting unit 38*b* is performed, dressing of the cutting blade 40 mounted to the cutting unit 38*a* can also be carried out similarly.

When the dressing of the cutting blade 40 is completed, an upper surface side of the rigid plate 27 is held by the conveying unit 32 (FIG. 1), and the dressing member 23 is conveyed from the chuck table 14 to the cleaning unit 44. Then, cleaning of the dressing board 25 is conducted by the cleaning unit 44. When the cleaning of the dressing board 25 is completed, the dressing member 23 is conveyed onto the pair of guide rails 18 by the conveying unit 26. Then, alignment of the dressing member 23 is conducted by the pair of guide rails 18. Thereafter, the conveying unit 26, in a state in which the rigid plate 27 is grasped by the grasping section 26*a*, moves toward the cassette 8 side, and accommodates the dressing member 23 into the cassette 8. In this way, dressing of the cutting blade 40 is performed.

As has been described above, the dressing member 23 according to the present embodiment includes the dressing board 25 cut by the cutting blade 40, and the rigid plate 27 fixed to the dressing board 25. As a result, it is possible to enlarge the dressing board 25 in size and to realize a reduction in cost, while performing the conveyance and holding of the dressing member 23 in the cutting apparatus 2 similarly to the workpiece unit 11.

Note that the shape of the dressing board 25 may be a perfect rectangle (square or rectangle), or may be substantially a rectangle. For example, corner parts (apexes of the front surface 25*a* and the back surface 25*b*) of the dressing board 25 may be slightly curved. It is to be noted, however, that when the cutting blade 40 makes contact with the curved region of the dressing board 25 when cutting into the dressing board 25 (see FIG. 7B), deformation of the cutting blade 40 is liable to occur. In view of this, the shape of the dressing board 25 is preferably a rectangle. As a result, the corner parts of the dressing board 25 can also be used effectively for dressing of the cutting blade 40.

Other than the above points, the structures, methods, and the like according to the present embodiment can be carried out with appropriate modifications insofar as the modifications do not depart from the scope of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A dressing member to be used for dressing of a cutting blade carried out by a cutting apparatus including a chuck table that holds a workpiece, a cutting unit that cuts the workpiece held by the chuck table by the cutting blade, a cassette mounting section on which a cassette, accommodating the workpiece and a plurality of additional workpieces, is mounted, and a conveying unit that conveys the workpiece between the cassette mounted on the cassette mounting section and the chuck table, the dressing member comprising:

a dressing board to be cut by the cutting blade; and a rigid plate having a front surface and a back surface, the dressing board fixed directly to the front surface of the rigid plate, wherein the conveying unit is configured to convey the dressing member from the cassette and to convey the dressing member into the cassette;

wherein the chuck table is configured to hold the dressing member; and wherein the rigid plate includes a mark section indicating the orientation of the rigid plate.

2. The dressing member according to claim 1, comprising:

an information display section that displays information concerning the dressing board.

3. The dressing member according to claim 1, wherein the workpiece is supported by an annular frame through a tape, and an outline of a peripheral edge of the rigid plate corresponds to an outline of a peripheral edge of the frame.

4. A dressing member to be used for dressing of a cutting blade carried out by a cutting apparatus including a chuck table that holds a workpiece, a cutting unit that cuts the workpiece held by the chuck table by the cutting blade, a cassette mounting section on which a cassette, accommodating the workpiece and a plurality of additional workpieces, is mounted, and a conveying unit that conveys the workpiece between the cassette mounted on the cassette mounting section and the chuck table, the dressing member comprising:

a dressing board to be cut by the cutting blade; and a rigid plate fixed to the dressing board, wherein the conveying unit is configured to convey the dressing member from the cassette and to convey the dressing member into the cassette;

wherein the chuck table is configured to hold the dressing member; and wherein the chuck table includes a circular holding surface that holds the workpiece and the rigid plate, the dressing board is rectangular in shape, and a length of a diagonal of the dressing board is greater than a diameter of the circular holding surface.

5. The dressing member according to claim 4, comprising:

an information display section that displays information concerning the dressing board.

6. The dressing member according to claim 4, wherein the workpiece is supported by an annular frame through a tape, and an outline of a peripheral edge of the rigid plate corresponds to an outline of a peripheral edge of the frame.

7. The dressing member according to claim 4, wherein the dressing board is fixed to a front surface of the rigid plate.

* * * * *